US006923441B2

(12) United States Patent
Inoue

(10) Patent No.: US 6,923,441 B2
(45) Date of Patent: Aug. 2, 2005

(54) SYMBOL DISPLAY DEVICE FOR GAME MACHINE

(75) Inventor: Haruo Inoue, Tokyo (JP)

(73) Assignee: Dragon Co. Ltd., Tokyo (JP)

( * ) Notice: Subject to any disclaimer, the term of this patent is extended or adjusted under 35 U.S.C. 154(b) by 0 days.

(21) Appl. No.: 10/618,745

(22) Filed: Jul. 15, 2003

(65) Prior Publication Data

US 2004/0155399 A1 Aug. 12, 2004

(30) Foreign Application Priority Data

Feb. 7, 2003 (JP) ..... 2003-031330

(51) Int. Cl.[7] ..... A63B 71/00
(52) U.S. Cl. ..... 273/143 R; 463/20
(58) Field of Search ..... 273/143 R, 138.2, 273/274; 463/16, 20

(56) References Cited

U.S. PATENT DOCUMENTS 5,152,529 A * 10/1992 Okada ..... 463/20
5,395,111 A * 3/1995 Inoue ..... 273/143 R
5,722,891 A * 3/1998 Inoue ..... 463/20
5,752,881 A * 5/1998 Inoue ..... 463/20
6,105,962 A * 8/2000 Malavazos et al. ..... 273/143 R
6,394,902 B1 * 5/2002 Glavich et al. ..... 463/20
6,598,877 B1 * 7/2003 Luciano et al. ..... 273/142 R

FOREIGN PATENT DOCUMENTS

| | | |
|---|---|---|
| JP | 6-327807 | 11/1994 |
| JP | 7-22301 | 5/1995 |
| JP | B2 8-17846 | 2/1996 |
| JP | 2000-116843 | 4/2000 |

* cited by examiner

*Primary Examiner*—Kurt Fernstrom
(74) *Attorney, Agent, or Firm*—Young & Thompson

(57) ABSTRACT

Transparent blank symbols are provided in each of first, second and third display plates. The player wins if the same symbols of the first to third display plates are arranged in line on any of winning lines when the first to third display plates stop rotating. When the blank symbols of the first to third display plates are arranged in line on any of winning lines, the sub reel rotates to display the symbols in motion. Then, the sub reel stops its rotation to display the still symbol. The symbol on the sub reel is observable through transparent parts in the blank symbols.

23 Claims, 15 Drawing Sheets

SYMBOL DISPLAY DEVICE FOR GAME MACHINE

BACKGROUND OF THE INVENTION

1. Field of the Invention

The present invention relates to a symbol display device mounted in a game machine, such as a roulette game machine. The symbol display device displays the win or the loss of the game by rotating and stopping display members with predetermined symbols.

2. Description Related to the Prior Art

A symbol display device mounted in a slot game machine or a Pachinko game machine generally uses reels that are arranged in lines or in a matrix. Some symbol display devices use a liquid crystal display to simulate the rotation of the reels. For instance, Japanese Patent Laid-Open Publication (JP-A) No. 2000-116843 describes a symbol display device that determines the win or loss in accordance with the combination of the symbols displayed on a rotary reel (first display) having a transparent window and a second display inside the first display. The second display is a liquid crystal display panel or a rotary reel having a diameter different from that of the first display. Additionally, U.S. Pat. No. 5,152,529 describes another example of the symbol display device that uses double structured reel composed of an outer reel having an opening and an inner reel disposed inside the outer reel. The game machines with the symbol display devices described above may change the symbols twice and provide a variety of symbol display patterns.

However, the symbols of the second display are exposed when the transparent window or the opening is on the winning line. Such symbol display devices have limitations to provide various symbol patterns. Moreover, two concentric reels may increase the manufacture cost.

The symbol display device, described in Japanese Utility-Model Publication No. H07-22301, has three concentric rotary disks. The player wins if a predetermined combination of the symbols on the rotary disks is displayed in a radial direction. Such symbol display device may be more compact than that having mechanical reels arranged in lines or in a matrix. Such symbol display device, however, has insufficient display patterns in a game because a player can observe all the symbols. Thus, sufficient appeal to a player is not expected.

In order to solve the above problems, a symbol display device described in JP-A H06-327807 has a first display device having a round rotator, for example, and a second display device having mechanical reels disposed inside of the round rotator. When a player plays a game machine that mounts such symbol display device, the first display device executes roulette game, and the second display device is operated if the player wins in the roulette game. If the player wins in the slot game executed by the second display device, the points gained by winning in the slot game is added to the points gained in the roulette game, so as to encourage the player's expectation to win. Although playing different games continuously may prevent a player from being dull, a game machine is not organized because of less association between the first and the second display devices.

SUMMARY OF THE INVENTION

An object of the present invention is to provide a symbol display device for a game machine that provides various display patterns associated with the game result.

Another object of the present invention is to provide a symbol display device that improves the appeal effect to a player.

In order to achieve the above objects, the symbol display device comprises plural main display units, a sub display unit located behind the main display units, and a winning judging section that judges the win or the loss in accordance with the combination of the displayed symbols of the main display units, the displayed symbol of the sub display unit or the combination of the displayed symbols of the main and sub display units.

The main display unit has a display part with at least one symbol area, in which a symbol is provided, and at least one light-penetrate area in the front side. The main display units are arranged so as to expose the display parts. The sub display unit displays symbols in motion and/or a static symbol behind at least one of the light-penetrate area. The sub display unit is a mechanical reel or a liquid crystal display device.

In the preferred embodiment, the display part is composed of at least one symbol area and at least one transparent non-symbol area. The light-penetrate area is the non-symbol area, a transparent area inside the symbol, or a transparent area outside the symbol in the symbol area.

The main display unit has at least one transparent part inside or outside of the display part. In that case, the displayed symbol of the sub display unit is validated when the main display units stop and when the light-penetrate area of one main display unit is overlapped with the transparent parts of other main display units in front of the sub display unit.

The displayed symbol of the sub display unit may be validated when the main display units stop and when the light-penetrate areas of the main display units are arranged in line in front of the sub display unit. It is possible to overlap the symbol of the sub display unit with the symbol of the main display unit so as to form a single composite symbol.

The winning judging section may judge the win or the loss in accordance with the displayed symbol of the sub display unit or the combination of the displayed symbols of the main and sub display units.

According to the present invention, since the display patterns of two different games by the main display units and the sub display unit are associated with each other, it is possible to improve the appeal effect to a player.

BRIEF DISCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
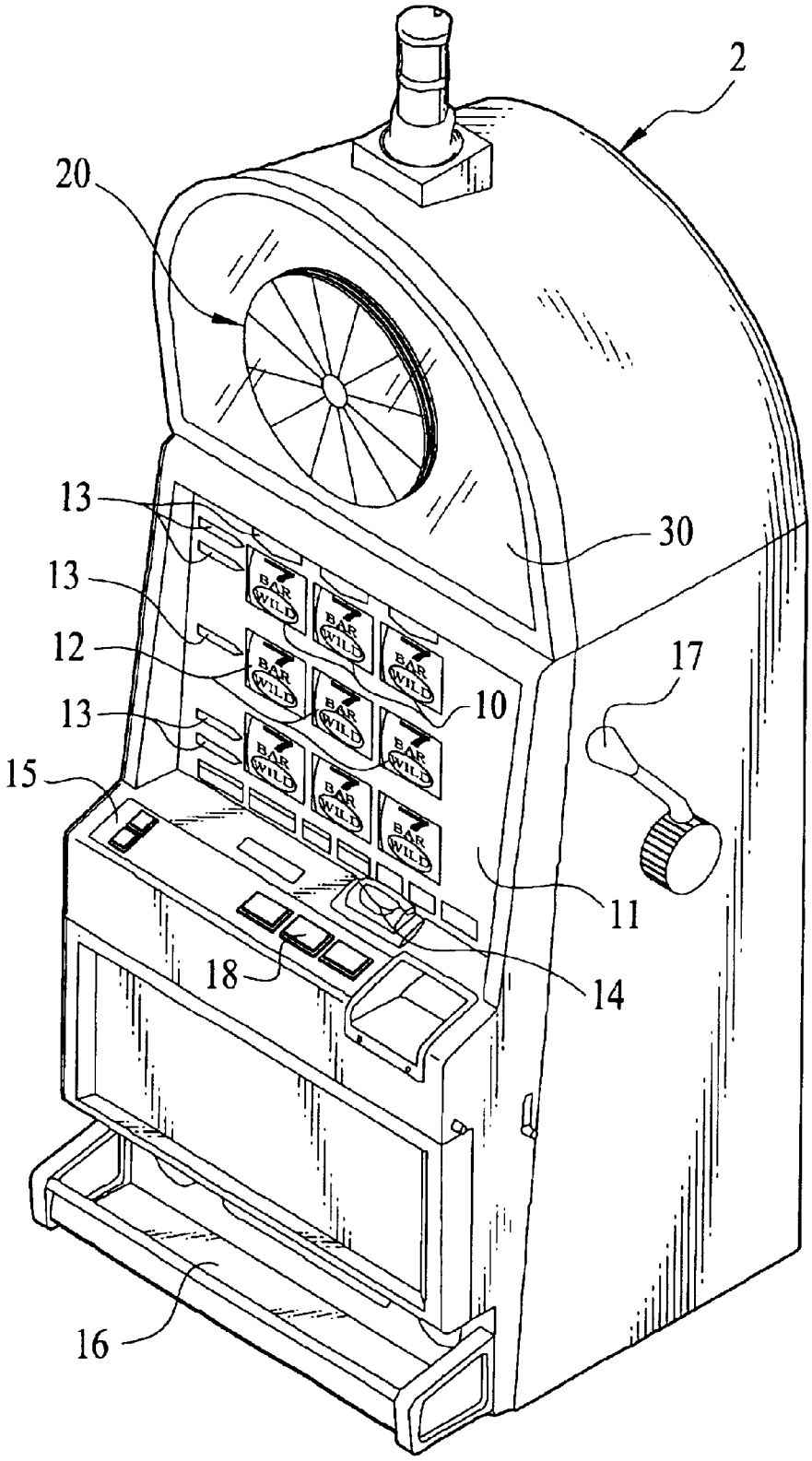
FIG. 1 is a front perspective view of a slot machine in which a symbol display device of the present invention is mounted.

As shown in FIG. 1, a slot game machine 2 has a front panel 11, wherein display windows 10 are arranged in a matrix of 3 lines and 3 rows. Reel units (not shown) are disposed behind the display windows 10 of the front panel 11, and three symbols in lengthwise direction disposed on each reel 12 may be observed through the display window 10 when the reel 12 of the reel unit stops rotating. The result of the game (win or loss) is determined in accordance with the symbol combinations on eight winning lines running vertically, horizontally and diagonally, or a symbol stopped in the display window 10. Indicators 13 are provided in the front panel 11 to indicate the winning lines. A coin slot 14, an operation panel 15 and a coin tray 16 are provided below the front panel 11. A start lever 17 is provided at the lateral side of the slot game machine 2.

The operation panel 15 has buttons such as a bet button 18 and a payout button. When the bet button 18 is operated to select the number of the coins to be betted, the winning line to be validated is determined. For example, one winning line is validated when one coin is betted, and eight winning lines are validated in maximum betting. Then, the game is started by the operation of the start lever 17, and each reel automatically stops at stop positions to display the symbols determined in accordance with random numbers sampled in advance. If a winning symbol combination stops on the winning line or a winning symbol is displayed, dividend coins are dispensed to the coin tray 16. The amount of the dividend coins is determined based on the type of the win.

Figure 2:
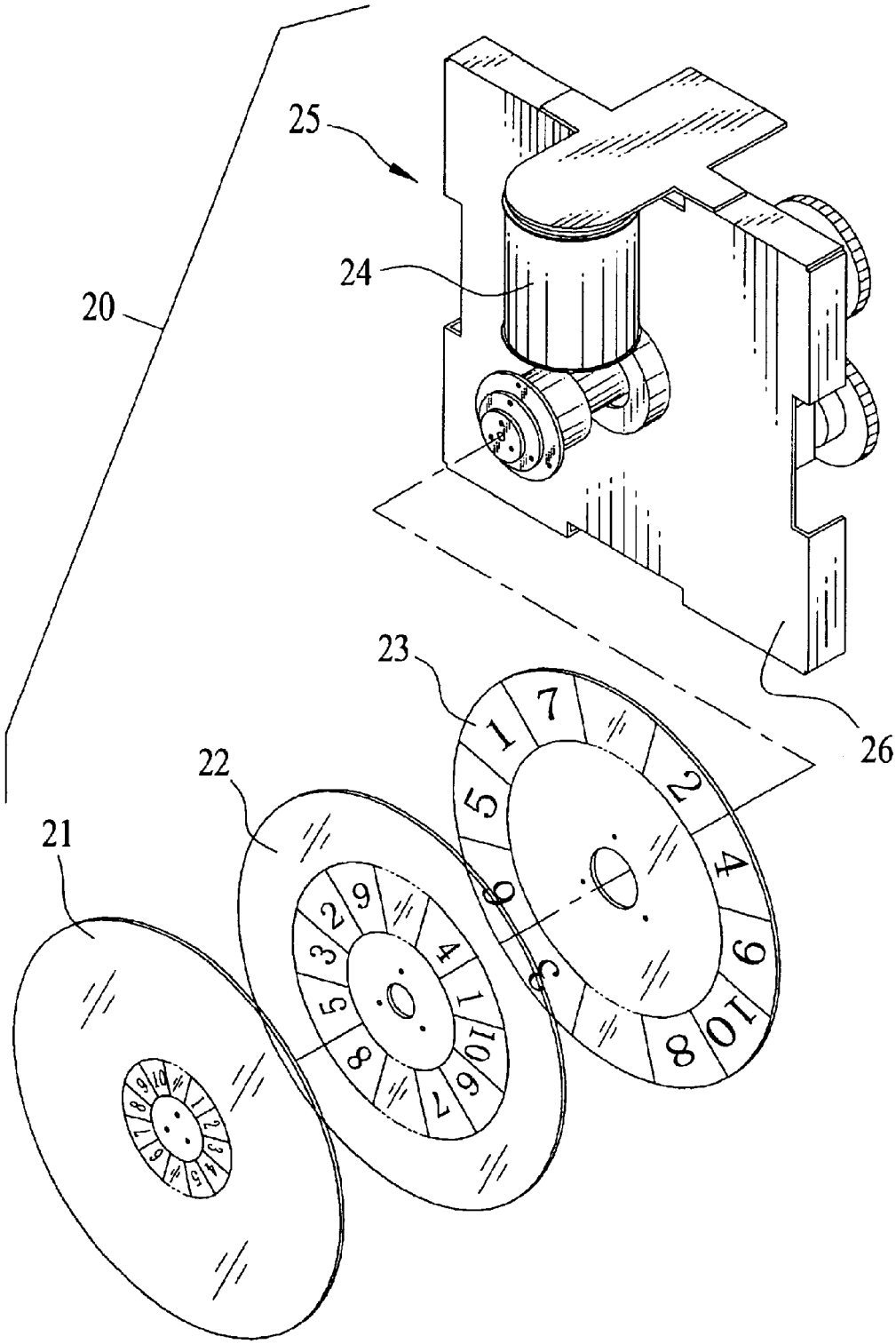
FIG. 2 is a perspective view of the symbol display device.

A symbol display device 20 mounted in the slot game machine 2 is disposed above the front panel 11. The symbol display device 20 executes the roulette game (sub game) if the player wins in the slot game (main game) using the reels. As shown in FIG. 2, the symbol display device 20 is a unit composed of first, second and third display plates 21, 22 and 23, a sub reel 24, a display driver 25 and a support plate 26. The symbol display device 20 is covered with a front door 30 (see FIG. 1). Although the symbol display device 20 is used for the sub game device in the present embodiment, the symbol display device 20 may be utilized as means to determine the amount of the dividend coins, for instance.

Figure 3:
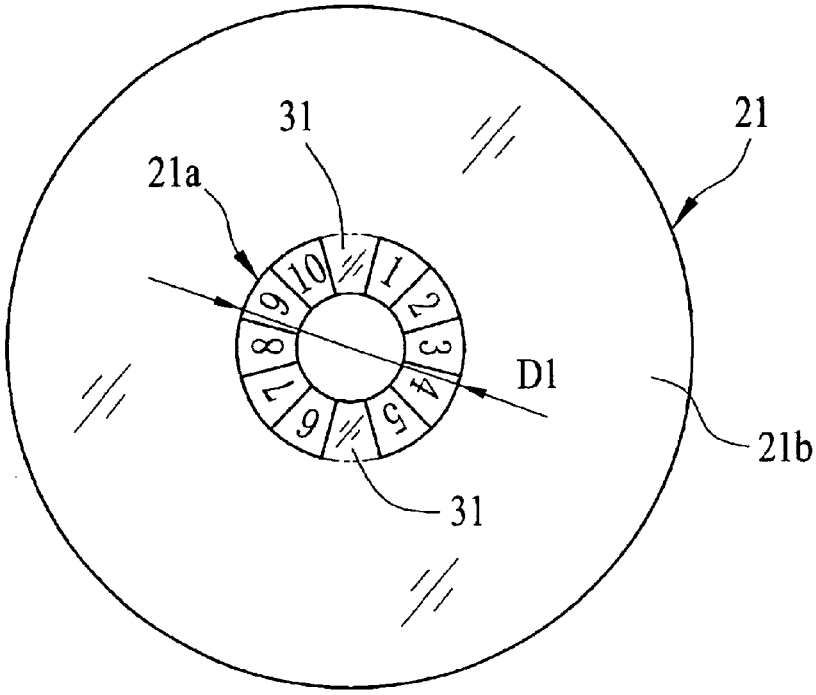
FIGS. 3, 4 and 5 are front views illustrating respectively examples of a first, a second and a third display plates.
Figure 4:
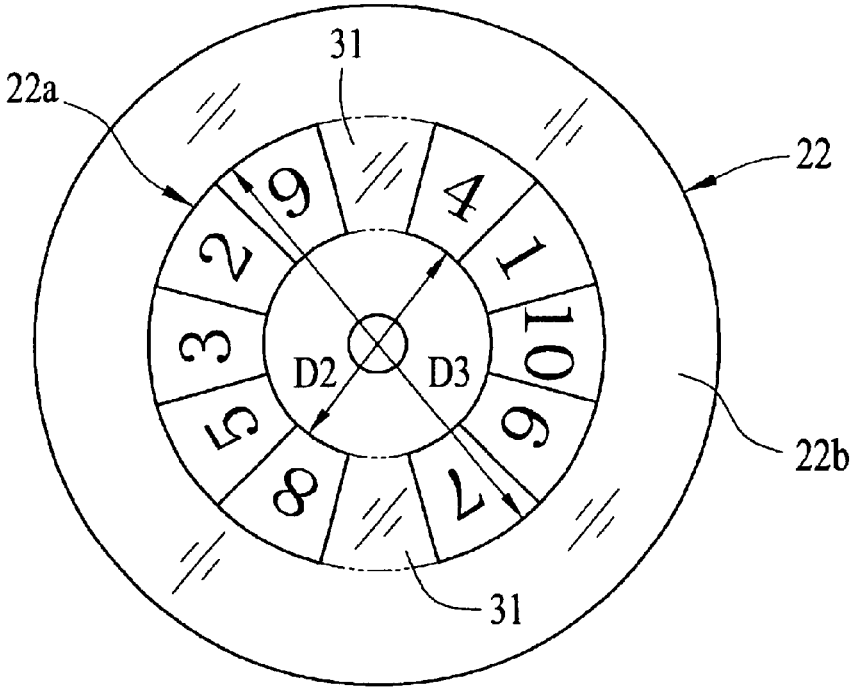
Figure 5:
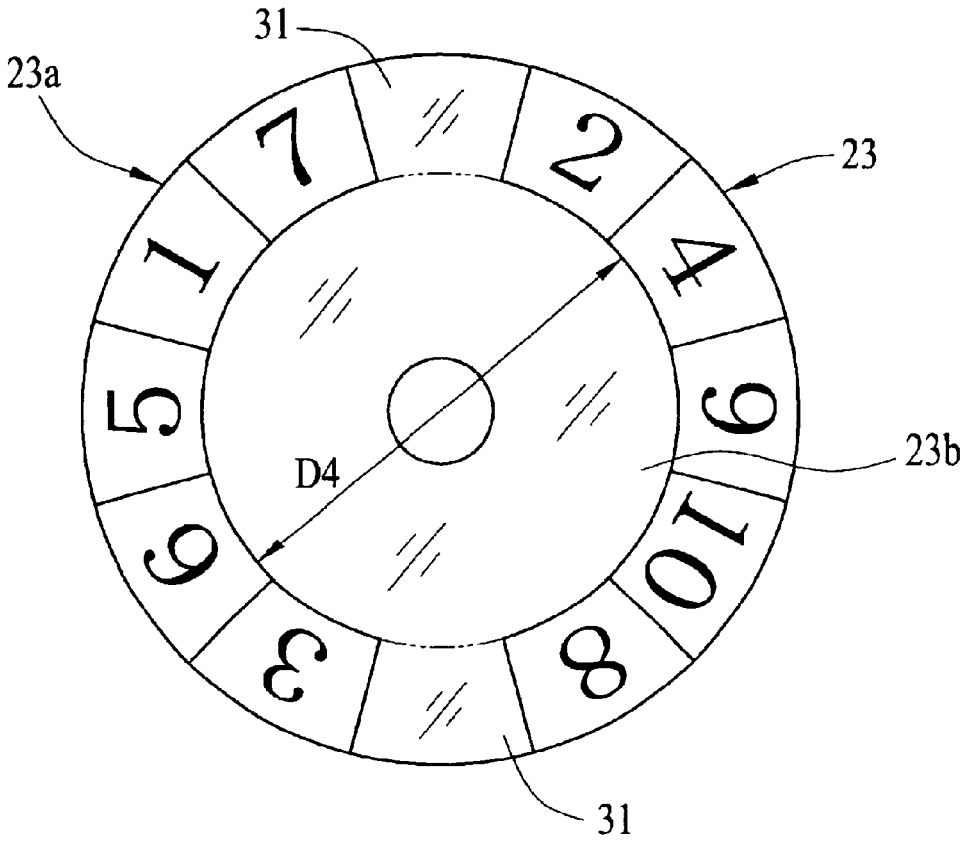

As shown in from FIGS. 3, 4 and 5, each of the first, second and third display plates 21, 22 and 23 are respectively composed of transparent circular plate having the same diameter. A first, second and third display parts 21*a*, 22*a* and 23*a* are provided in the first, second and third display plates 21, 22 and 23, respectively. The first display part 21*a* in the first display plate 21 is the smallest while the third display part 23*a* in the third display plate 23 is the largest. The outer diameter D1 of the first display part 21*a* has the same length as the inner diameter D2 of the second display part 22*a*, while the outer diameter D3 of the second display part 22*a* has the same length as the inner diameter D4 of the third display part 23*a*.

The second display plate 22 is disposed in front of the third display plate 23, and the first display plate 21 is disposed in front of the second display plate 22. The third display plate 23 is disposed in front of the display driver 25. The first, second and third display plates 21, 22 and 23 are concentrically attached to the display driver 25. Accordingly, the display part 22*a* of the second display plate 22 is observable through the transparent part 21*b* of the first display plate 21, and the display part 23*a* of the third display plate 23 is observable through the transparent part 21*b* of the first display plate 21 and the transparent part 22*b* of the second display plate 22. Thereby, the first, second and third display parts 21*a*, 22*a* and 23*a* are disposed concentrically and adjacent to each other (see FIG. 10). The first, second and third display plates 21, 22 and 23 constitute main display means to perform a first winning display.

Each of the display parts 21*a*, 22*a* and 23*a* is divided into plural cells corresponding to the number of the disposed symbols. For example, each display part is divided into twelve cells for number symbols of "1" to "10" and two blank symbols 31. Note that the blank symbol 31 is a cell without a mark. The blank symbol 31 is transparent so that at least one symbol on the display part behind the blank symbol 31 is observable. Twelve symbols on the first, second and third display plate parts 21*a*, 22*a* and 23*a*, form winning lines in radial directions (indicated by reference numerals from 90 to 101 in FIG. 10).

The first to third display parts 21*a*, 22*a* and 23*a* may have other symbol type than the number. Examples of other symbol type are marks, signs, color and pictures. Arrangement and the number of the symbols including the blank symbols on the display parts 21*a*, 22*a* and 23*a* are not limited in the embodiment shown in FIGS. 3, 4 and 5, but may be determined appropriately. Furthermore, though borderlines between the blank symbols and the transparent parts are shown by chain double-dashed lines, it is possible to omit the borderlines.

Figure 6:
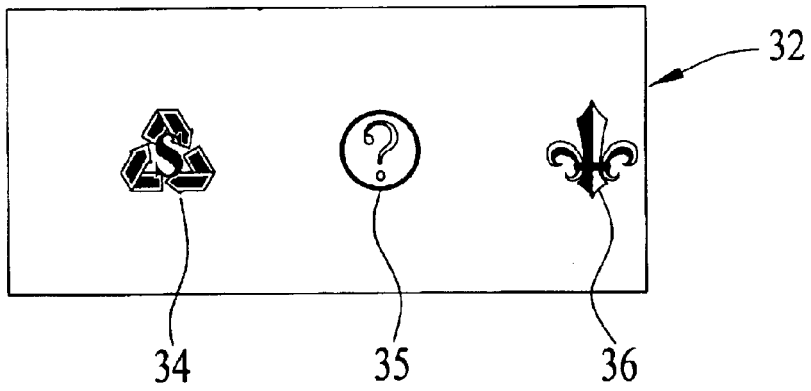
FIG. 6 is a front view illustrating an example of a symbol sheet attached to a periphery of a sub reel.

The sub reel 24 is disposed behind the first, second and third displays 21, 22 and 23 such that the axial direction thereof crosses the first, second and third display parts 21*a*, 22*a* and 23*a*. As shown in FIG. 6, a symbol sheet 32, whereon plural symbols 34, 35 and 36 and the blank symbols 37 are disposed alternately, is attached to the sub reel 24. The symbols 34, 35 and 36 respectively represent the win, the loss and re-rotation of the first, second and third display plates 21, 22 and 23.

The sub reel 24 normally displays the blank symbol when it is not rotating. When the same number symbols in the first to third display parts 21*a*, 22*a* and 23*a* are not arranged in line and when the blank symbols 31 of the display plates 21, 22 and 23 are arranged axially in line, the reel mounting plate 24 starts rotating to display the symbols in motion (see FIG. 12). Then, the sub reel 24 stops the rotation to display a symbol representing the win, the loss or the re-rotation of the display plates 21, 22 and 23 through the blank symbols 31. The sub reel 24 functions as sub display means to perform a second winning display.

Figure 7:
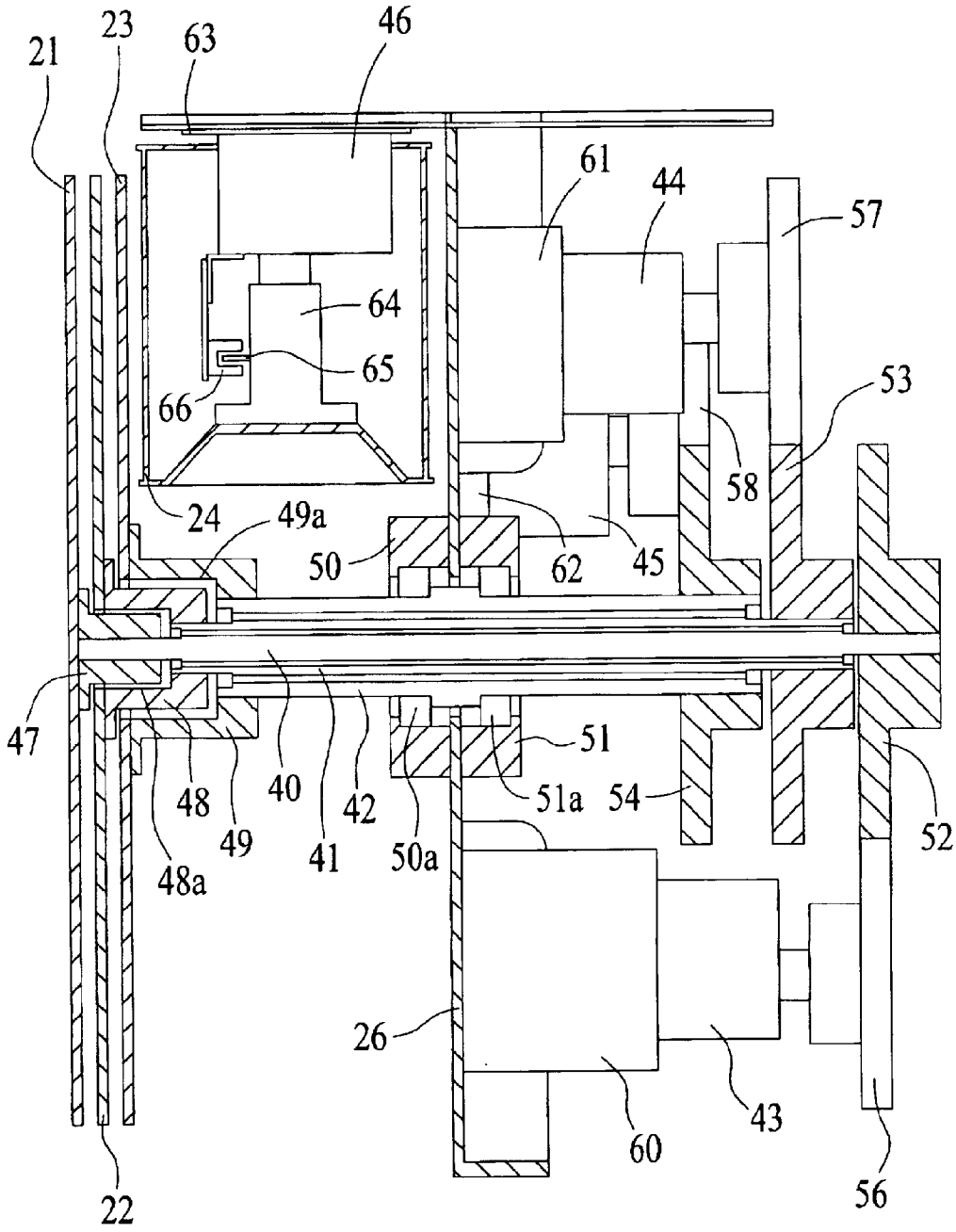
FIG. 7 is a cross section illustrating the structure of the symbols display device.

As shown in FIG. 7, the display driver 25 is provided with first, second and third rotary shafts 40, 41 and 42, and first, second, third and fourth drive motors 43, 44, 45 and 46. The second and third rotary shafts 41, 42 have tubular shapes. The first to third display plates 21, 22 and 23 are firmly screwed to first, second and third flanges 47, 48 and 49 that are respectively fixed to the one ends of the first to third rotary shafts 40, 41, and 42. A portion of the first flange 47 is fitted into a concave part 48*a* formed in the second flange 48. A portion of the second flange 48 is fitted into a concave part 49*a* formed in the third flange 49.

The first rotary shaft 40 is inserted into the hollow part of the second rotary shaft 41 and determined its position by bearings (not shown) attached to both ends of the second rotary shaft 41. Thereby, the first rotary shaft 40 and the second rotary shaft 41 are held concentrically, so are the first display plate 21 and the second display plate 22. Similarly, the second rotary shaft 41 is inserted into the hollow part of the third rotary shaft 42 and determined its position by the bearings (not shown) attached to both ends of the third rotary shaft 42. Thereby, the second rotary shaft 41 and the third rotary shaft 42 are held concentrically, so are the second display plate 22 and the third display plate 23.

Accordingly, the first to third rotary shafts 40, 41 and 42 are held concentrically, and the first to third display plates 21, 22 and 23 are held concentrically as well. The third rotary shaft 42 is fixed to the support plate 26 by bearing members 50 and 51. Note that the reference numerical 50*a* and 51*a* represent bearings to enable smooth rotation of the third rotary shaft 42. Gears 52, 53 and 54 are respectively fixed to the other ends of the first to third rotary shafts 40, 41 and 42.

Each of the first to third drive motors 43, 44 and 45 is a stepping motor driven by drive pulses, and rotates the first to third display plates 21, 22 and 23. Gears 56, 57 and 58 fixed to the drive shafts of corresponding drive motors are respectively in mesh with the gears 52, 53 and 54 of the first to third rotary shafts 40, 41 and 42. Drive force of the first to third drive motors 43, 44 and 45 is transmitted to the first to third rotary shafts 40, 41 and 42 so as to rotate the first to third display plates 21, 22 and 23 individually. Each of the first to third drive motors 43, 44 and 45 is respectively held by brackets 60, 61 and 62 and fixed to the rear side of the support plate 26.

Each of the rotary shafts 40, 41 and 42 is provided with position detecting segments (not shown) to indicate the standard positions of the first to third display plates 21, 22 and 23. There are photo interrupters to detect the position detecting segments to detect that the first to third rotary shafts 40, 41 and 42 rotate by 360 degrees. Note that each of the first to third display plates 21, 22 and 23 is located at the standard position when the corresponding position detecting segment is detected by the photo interrupter.

The fourth drive motor 46 is fixed to the support plate 26 by a bracket 63. The sub reel 24 is attached to the drive shaft of the fourth drive motor 46 by a flange 64. Thereby, drive force of the fourth drive motor 46 is transmitted to the sub reel 24. A photo interrupter 66 can detect a position detecting segment 65, which is fixed to the flange 64, so as to detect the rotation of the sub reel 24. Note that, in the present embodiment, the sub reel 24 is located at the standard position when the position detecting segment 65 is detected by the photo interrupter 66.

Since the display driver 25 is fixed to the support plate 26 as a single unit, the symbol display device 20 becomes compact. Moreover, it is possible to improve workability, because the symbol display device 20 is easily mounted in the slot game machine 2 just by mounting the support plate 26 to a predetermined position. Note that the structure of the display driver 25 is not limited to the one in the above embodiment but other mechanism may be utilized. For example, a pulley and a toothed belt may be used instead of the gears.

Figure 8:
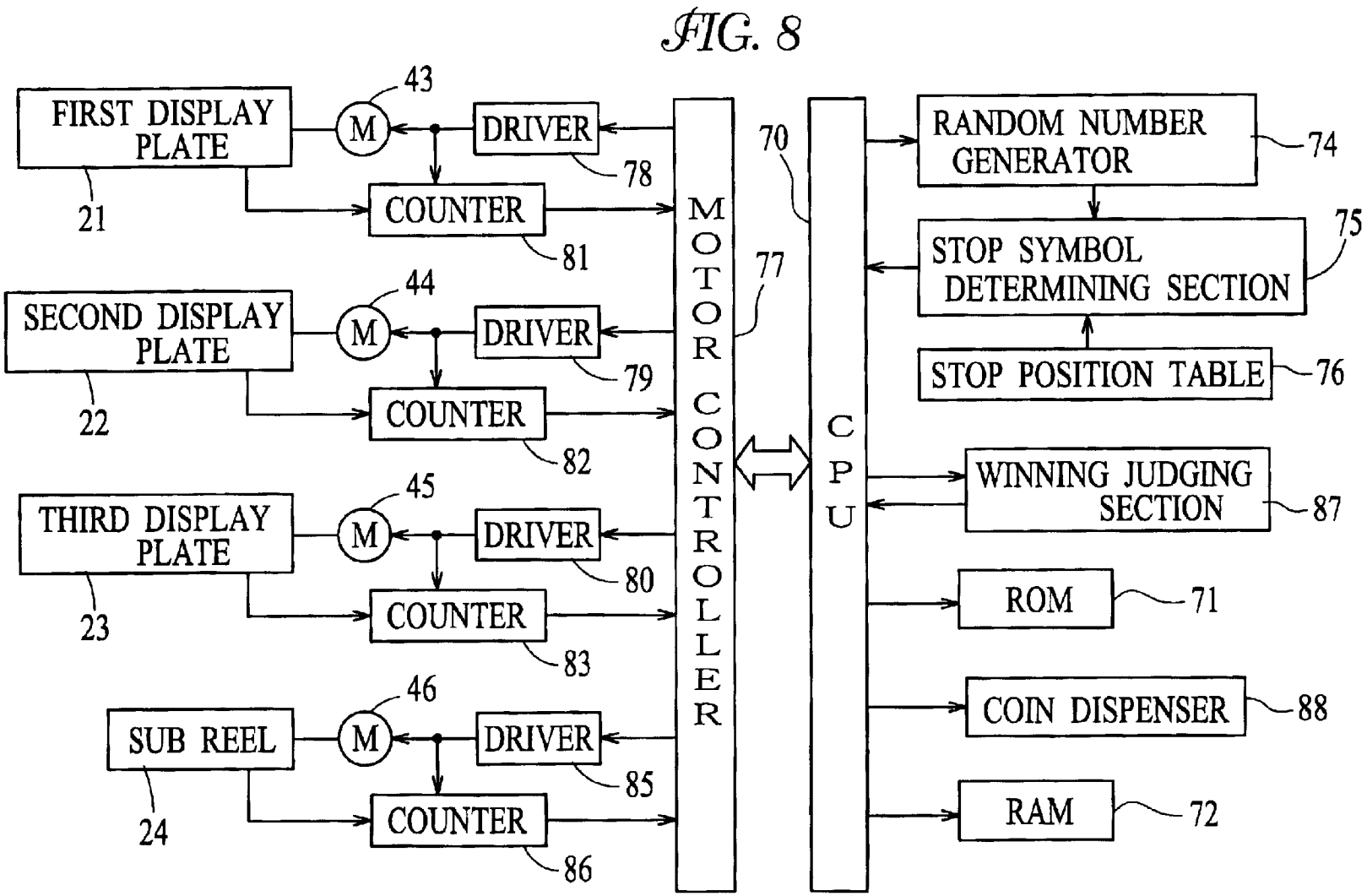
FIG. 8 is a functional block view illustrating a part of an electrical composition of the slot machine.

FIG. 8 is a functional block diagram showing an electrical structure of a part of the slot game machine 2 for executing the roulette game. Note that an explanation and drawing of a part for executing slot game are omitted. A CPU 70 controls each section in accordance with a roulette game program stored in a ROM 71 when the player wins in the slot game.

The ROM 71 stores pulse number data to specify the number of the drive pulse of the drive motors 44, 45 and 46 to rotate the first to third display plates 21, 22 and 23 by predetermined amount. On receiving a game start signal from the CPU 70, a random number generator 74 samples a random number and outputs it to a stop symbol determining section 75. The stop symbol determining section 75 determines the rotation amount of the first to third display plates 21, 22 and 23 with reference to a stop position table 76. The stop symbol determining section 75 obtains pulse number data for the first, second and third display plates 21, 22 and 23 from the ROM 71. Pulse number data is stored in the RAM 72. In addition, the stop symbol determining section 75 determines the display symbol of the sub reel 24.

A motor controller 77, operated in response to the game start signal from the CPU 70, drives the first to third drive motors 43, 44 and 45 through the drivers 78, 79 and 80. Each of counters 81, 82 and 83 counts the number of each of the drive pulse inputted to the first to third drive motors 43, 44 and 45. By monitoring the number of the drive pulses, the motor controller 77 specifies the rotational positions of the first to third display plates 21, 22 and 23. The CPU 90 outputs a rotation stop signal to the motor controller 77 when the counters 81, 82 and 83 count the same pulse numbers corresponding to pulse number data stored in the RAM 72. In response to the rotation stop signal, the motor controller 77 stops the first to third drive motors 43, 44 and 45. Note that the each count value of the counter 81, 82 and 83 is reset respectively at the time when the photo interrupter detects the position detecting segment.

The ROM 71 stores winning count value data for the counters 81, 82 and 83 at the time when winning symbol combinations appear on the winning lines 90 to 101. When the first to third displays 21, 22 and 23 stop rotation, a winning judging section 87 refers the count values of the counters 81, 82 and 83, and judges whether there is a winning symbol combination in any of the winning lines 90 to 101.

When there is no winning symbol combination in the winning lines 90 to 101, but when the blank symbols 31 on the first to third display parts 21*a*, 22*a* and 23*a* are arranged in line on any of the winning lines 90 to 101, the motor controller 77 drives the fourth drive motor 46 through a driver 85. Then, the sub reel 24 rotates to display the symbols 34, 35 and 36 in motion. The rotational position is monitored by a counter 86 to count the drive pulse of the fourth drive motor 46. When the stop symbol determining section 75 determines the display symbol of the sub reel 24, pulse number data corresponding to the display symbol is read from the ROM 71 and stored to the RAM 72. The motor controller 77 stops the fourth drive motor 46 when the count value of the counter 86 reaches the pulse number stored in RAM 72. Note that the count value of the counter 86 is reset at the time when the photo interrupter 66 detects the position detecting segment 65.

When the sub reel 24 stops the rotation, the winning judging section 87 judges the win or the loss based on the count value of the counter 86. If the winning judging section 87 judges that the re-rotation symbol 36 is displayed, the CPU 70 operates a random number generator 74 again. If the winning judging section 87 judges the win, the CPU 70 operates a coin dispenser 88 to dispense dividend coins, whose amount is determined based on the type of the win.

Figure 9:
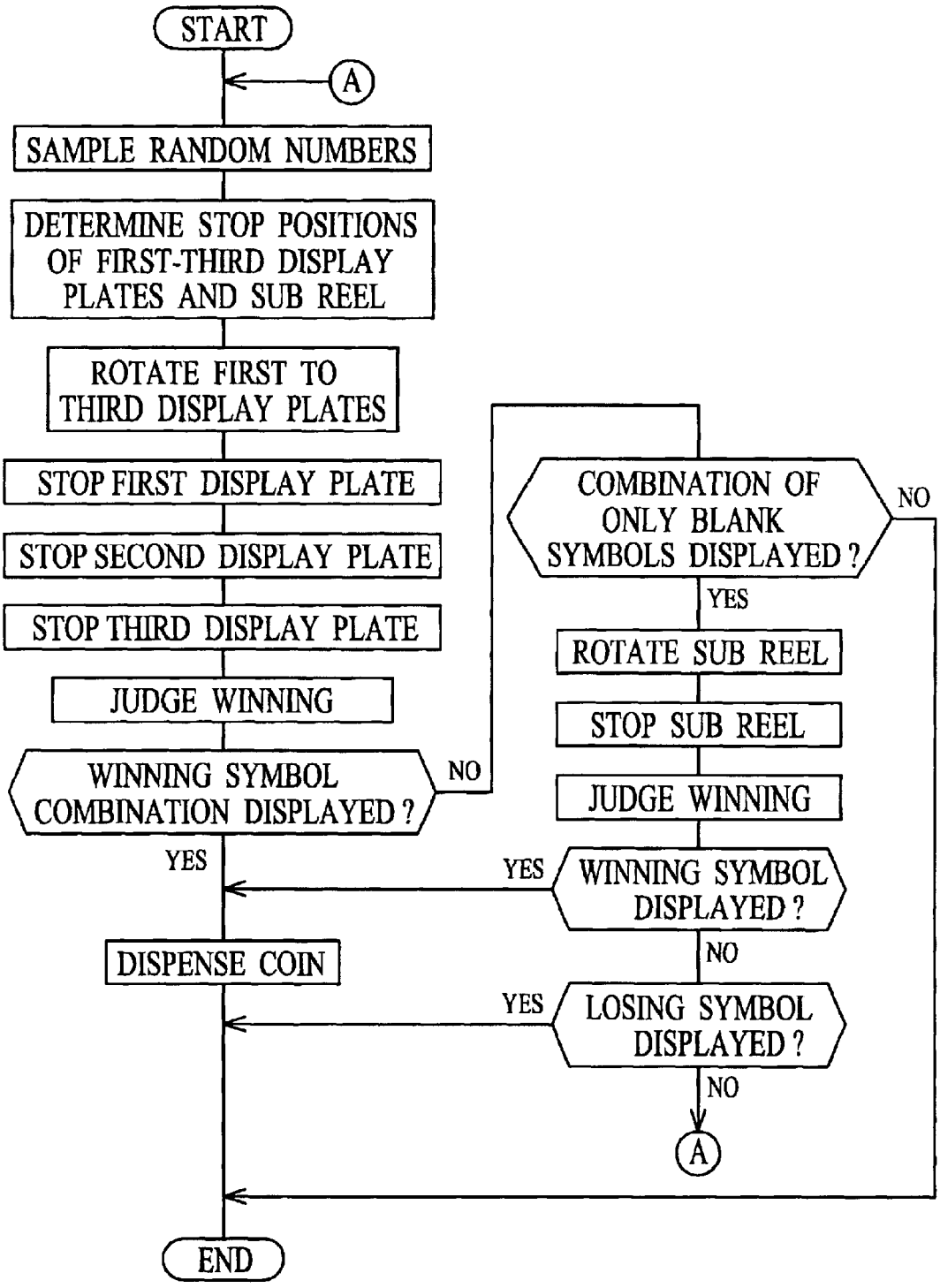
FIG. 9 is a flow chart showing the sequence of a sub game.

The function of the slot game machine, wherein the symbol display device structured as described above is mounted, is explained with reference to the flow chart of FIG. 9. Note that the explanation about the slot game as the main game is omitted so that only the roulette game as the sub game is explained.

If the player wins in the main game, the CPU 70 operates the random number generator 74 to sample a random number. Based on the sampled random number, the stop symbol determining section 75 determines the rotational amount of the first to third display plates 21, 22 and 23. Moreover, the stop symbol determining section 75 determines the stop symbol of the sub reel 24. Pulse number data to stop the first to third display plates 21, 22 and 23 and the sub reel is stored in the RAM 72. Simultaneously, the CPU 70 operates the motor controller 77 to rotate the first to third display plates 21, 22 and 23 clockwise, through the first to third drive motors 43, 44 and 45.

After the first to third display plates 21, 22 and 23 start rotating, the CPU 70 stops the first display plate 21 first, then the second display plate 22, and the third display plate 23 lastly, by use of a random timer (not shown). After all of the first to third display plates 21, 22 and 23 stop rotating, the CPU 70 operates the winning judging section 87 to judge whether there is a winning symbol combination on any of the winning lines 90 to 101.

Figure 10:
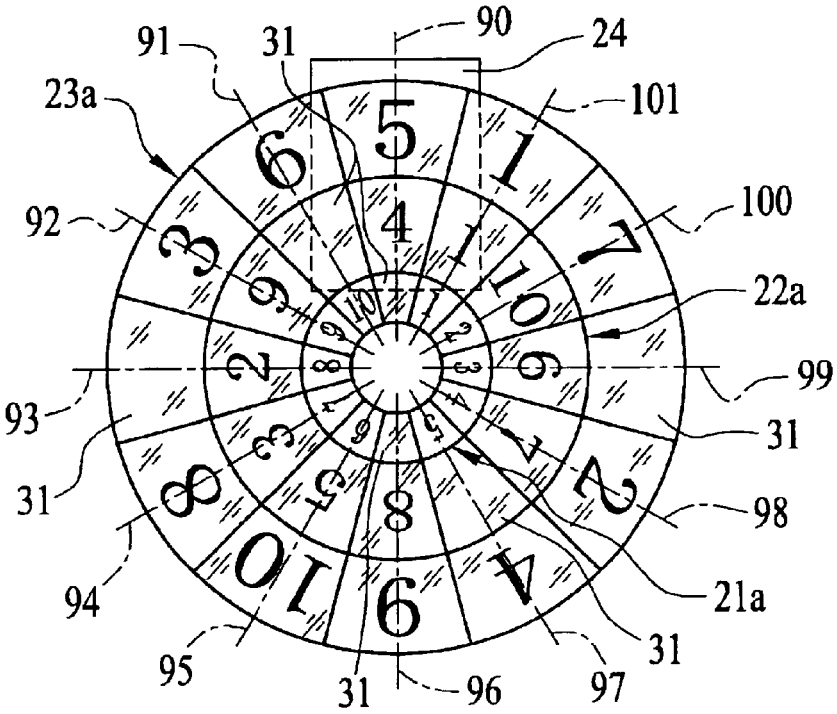
FIG. 10 is a front view illustrating an example of a winning symbol combination of first-third display parts.
Figure 11:
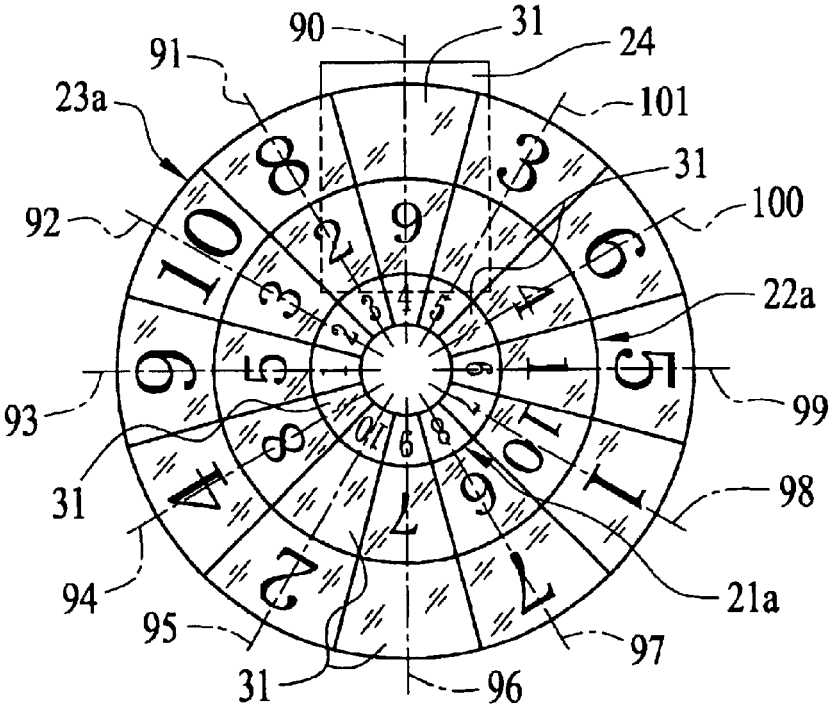
FIG. 11 is a front view illustrating an example of a losing symbol combination of the first-third display parts.

For example, as shown in FIG. 10, if the same symbols "1" of the first to third display parts 21*a*, 22*a* and 23*a* are arranged on the winning line 101, the CPU 70 judges the win and drive the coin dispenser 88 to dispense the dividend coins. The amount of dispensed coins is determined based on the type of the win. If the same symbols do not stop in line on any of the winning lines from 90 to 101 as shown in FIG. 11, the CPU 70 judges the loss and finishes the game and invalidates data of the display symbol of the sub reel 24.

Figure 12:
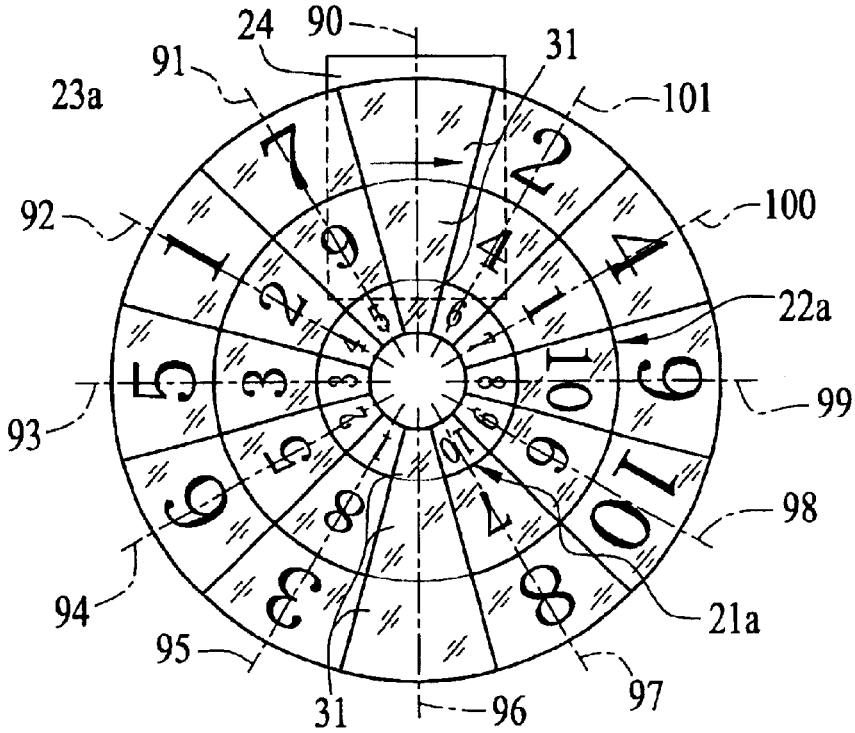
FIG. 12 is a front view illustrating an example wherein blank symbols are arranged in line.
Figure 13:
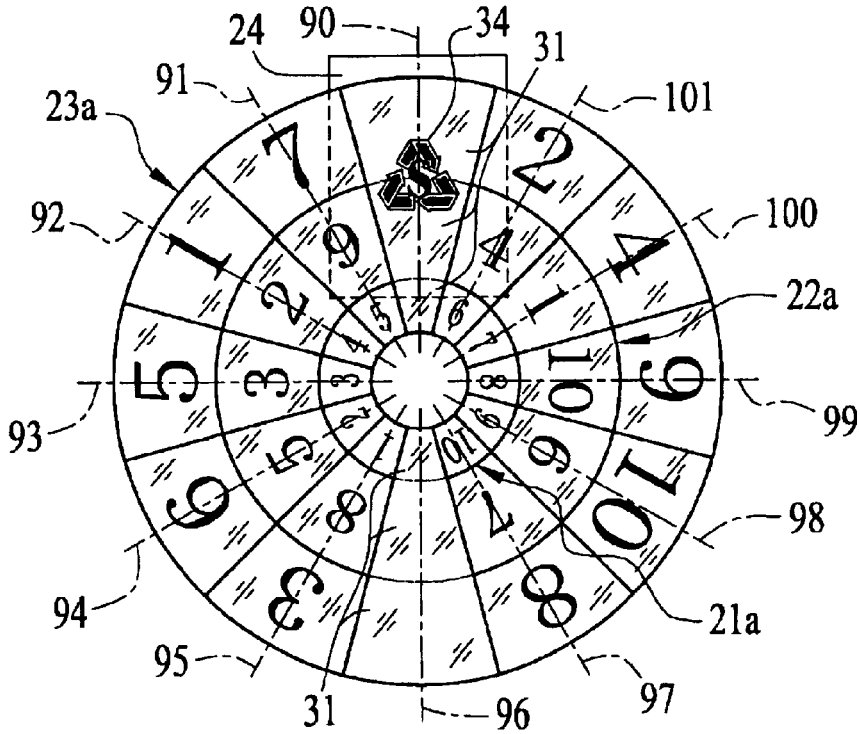
FIG. 13 is a front view illustrating an example wherein a winning symbol of the sub reel is displayed.
Figure 14:
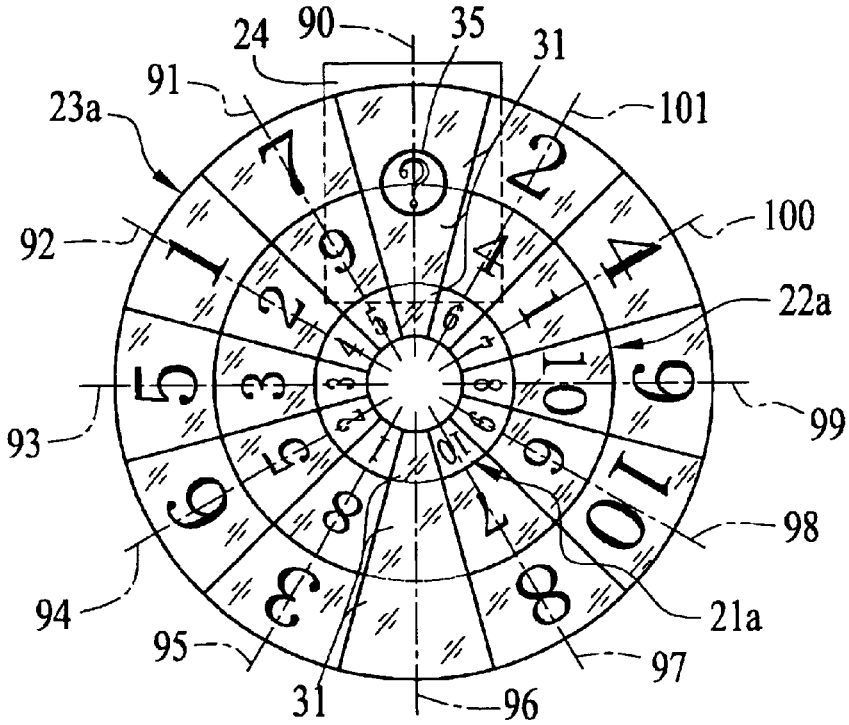
FIG. 14 is a front view illustrating an example wherein a losing symbol of the sub reel is displayed.

In the example of FIG. 12, there is no winning symbol combination in the winning lines 91 to 95 and 97 to 101. However, the blank symbols 31 of the first to third display plates 21, 22 and 23 are arranged on the winning line 90 and 96, and the sub reel 24 behind the winning line 90 is observed through the blank symbols 31 and the transparent parts 21*b*, 22*b* and 23*b*. In that case, the sub reel 24 is rotated to display the symbols in motion. After certain time has elapsed, the CPU 70 stops the rotation of the sub reel 24 to display one of the symbols of the sub reel 24 through the blank symbols 31. When the winning symbol 34 of the sub reel 24 is displayed through the blank symbols 31, as shown in FIG. 13, the player wins in this game and gets the dividend coins, whose amount is determined based on the type of the win. On the other hand, when the losing symbol 35 of the sub reel 24 is displayed, as shown in FIG. 14, the player loses in this game.

Figure 15:
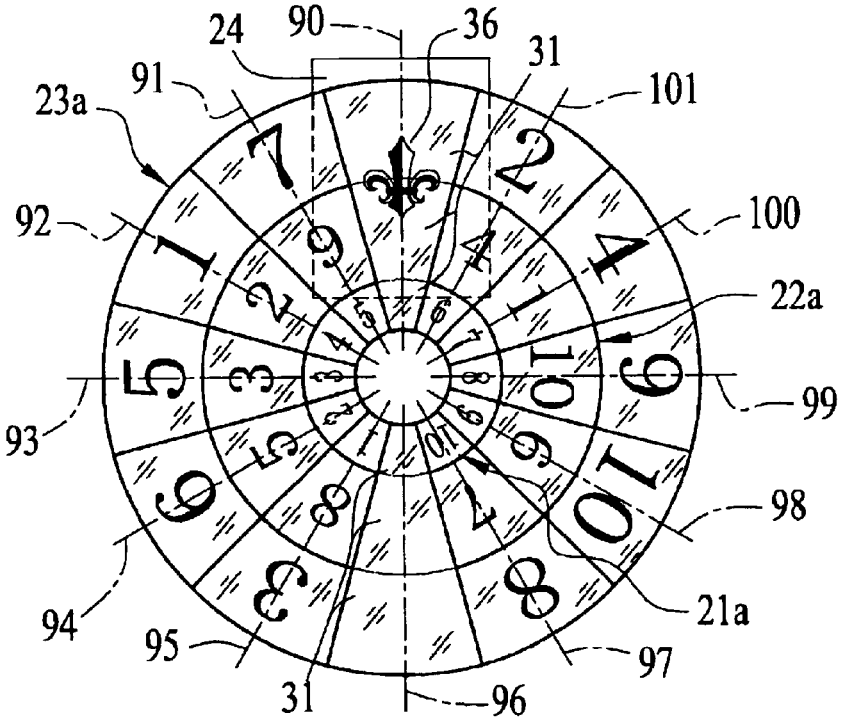
FIG. 15 is a front view illustrating an example wherein a re-rotation symbol of the sub reel is displayed.

If, as shown in FIG. 15, the re-rotation symbol 36 of the sub reel 24 is displayed when the sub reel 24 stops rotating, the first to third display plates 21, 22 and 23 start rotating again. After the first to third display plates 21, 22 and 23 stop rotation, the winning judging section 87 judges the win or loss, in the same manner described above. If the blank symbols 31 of the first to third display plate 21, 22 and 23 are arranged in front of the sub reel 24, the sub reel 24 starts rotation to display the symbol in motion. After the sub reel 24 is stopped, the win or the loss is determined based on the displayed symbol of the sub reel 24.

Since two different games in a single symbol display device are associated with each other, a player may continue to have expectation for the win in one game even after losing in the other game. Moreover, such symbol display device can provide sufficient appeal to a player by giving a variety of display types.

It is possible not to judge the win or the loss based on the combination of the displayed symbols of the display plates. In that case, the winning judging section may judge the win or the loss in accordance with the displayed symbol of the sub display unit or the combination of the displayed symbols of the main and sub display units.

The first to third display plates 21, 22 and 23 may rotate in the same direction, or one of them may rotate in the opposite direction. It is also possible to change the rotational speed of each of the first to third display plates 21, 22 and 23. The order to stop the rotation of the first to third display plates 21, 22 and 23 is not limited in the above embodiment.

If the two same symbols are arranged on one of the winning lines when two display plates stop rotating, the remaining display plate may rotate slowly or repeat the rotation in the clockwise and counterclockwise directions alternately such that the remaining display plate rotate clockwise little by little. Thereby, the symbol display device may provide a variety of performances to sustain the player's interest. The first to third display plates 21, 22 and 23 and the sub reel 24 may be stopped not only automatically but by the manual operation of the stop buttons.

Though lighting equipments such as lamps and LEDs are not described in the above embodiment, it is possible to emit light in the front panel 11 during the rotation of the first to third display plates and the sub reel. It is also possible to change the color of emitted light when one of the first to third display panels rotates in the opposite direction as other display panels.

The display device of the present invention may be composed of two or more than three display plates without losing the effects of the present invention. Note that the symbols other than the blank symbol may be transparent or non-transparent. The display plate is not necessarily transparent except the display part. For example, the area that overlaps the display part of other display plate may be partially opaque. In this case, the sub reel starts rotating behind the blank symbol only if the blank symbols of the first to third display plates are arranged in line on the same winning line and, simultaneously, the blank symbol is overlapped with the transparent parts of other display plates. On the other hand, if the blank symbol is overlapped with the opaque parts of other display plates, the sub reel does not rotate.

Although the sub reel in the above embodiment starts rotation after the first to third display plates stop rotating, it is possible to rotate the sub reel and the first to third display plates at the same time. A variety of display types may be realized by stopping the rotation of the sub reel while displaying the symbols of the first to third display plates in motion. Although the sub reel displays the blank symbol before the game, one of symbols may be displayed at that time. It is also possible to determine rotation of the sub reel by lottery, for instance, when the blank symbols of the first to third display plates are arranged in line.

Figure 16:
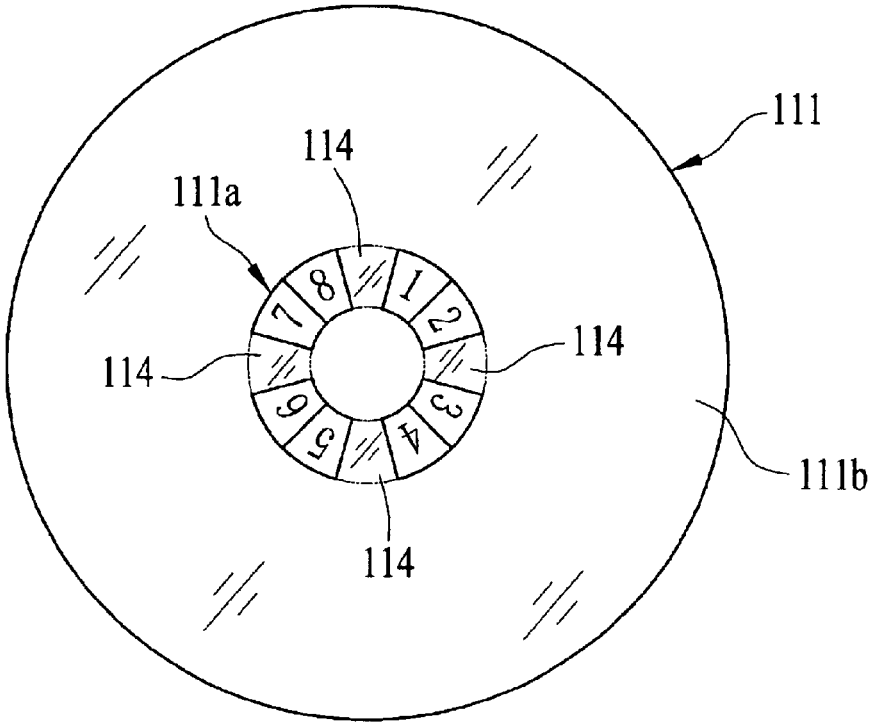
FIGS. 16, 17 and 18 are front views illustrating respectively examples of a first, a second and a third display plates with four blank symbols.
Figure 17:
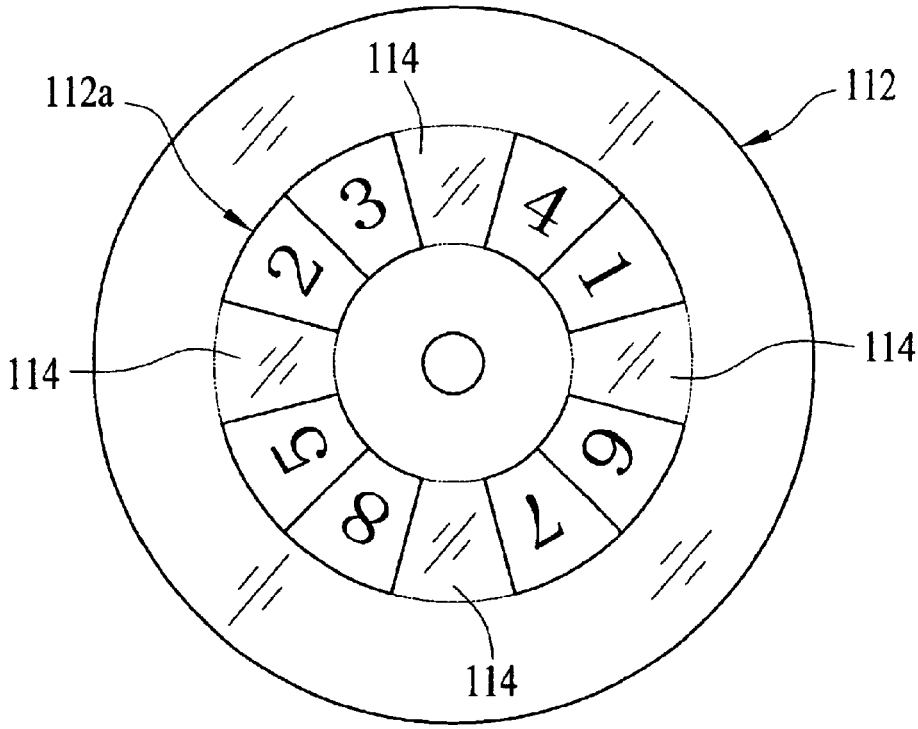
Figure 18:
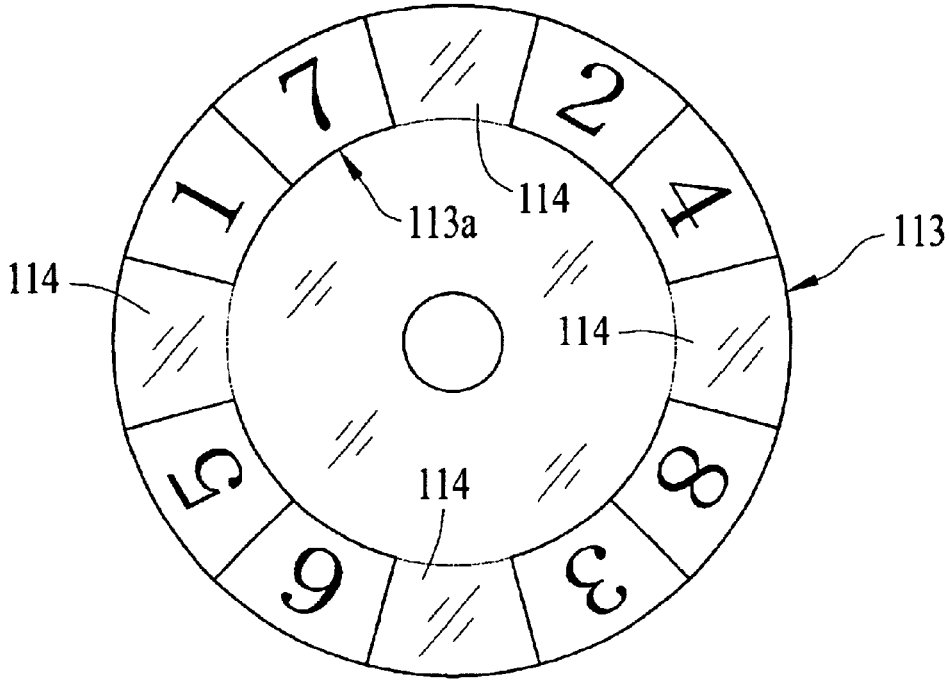
Figure 19:
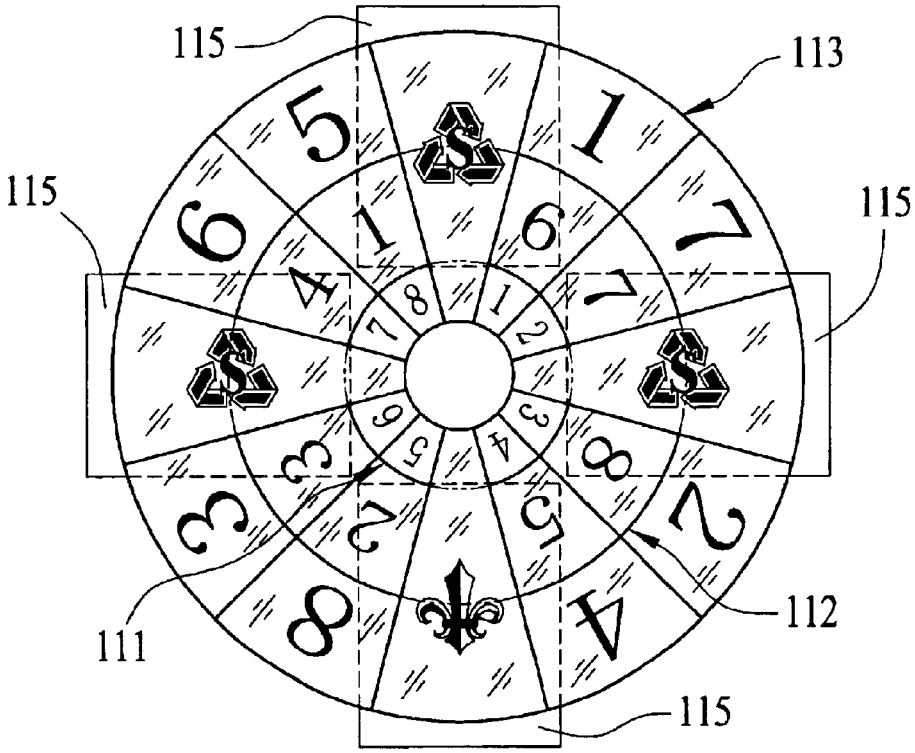
FIG. 19 is a front view illustrating an example of the winning by the combination of the four sub reels.

The position and the number of the sub reel are not limited to the embodiment described above. For instance, FIGS. 16, 17 and 18 illustrates the embodiment in which four blank symbols 114 are provided with 90 degrees rotational symmetry in each of the first to third display areas 111*a* to 113*a* of the first to third display plates 111 to 113. In FIG. 19, four sub reels 115 are disposed behind the first to third display plates 111 to 113 with 90 degree rotational symmetry. In this embodiment, the player wins the game when the same symbols of the first to third display plates 111 to 113 (as the first winning display) are arranged on one of the winning lines.

Even though there is no winning combination of the first to third display plates 111 to 113, four sub reels 115 starts rotating when the blank symbols 114 of the first to third display plates 111 to 113 are arranged in line in front of the sub reels 115. Then, the sub reels 115 stop rotation to display the symbols as the second winning display). The player wins the game if three or four same symbols of the sub reels 115 are displayed at the same time, regardless of the combination. In the embodiment shown in FIG. 19, the first to third display plates 111 to 113 start rotating again because the re-rotation symbol of the sub reel 115 is displayed. It is possible to provide a viewing frame between the sub reel 115 and the first to third display plates 111 to 113, for the purpose of facilitating the observation of the sub reel 115.

Figure 20:
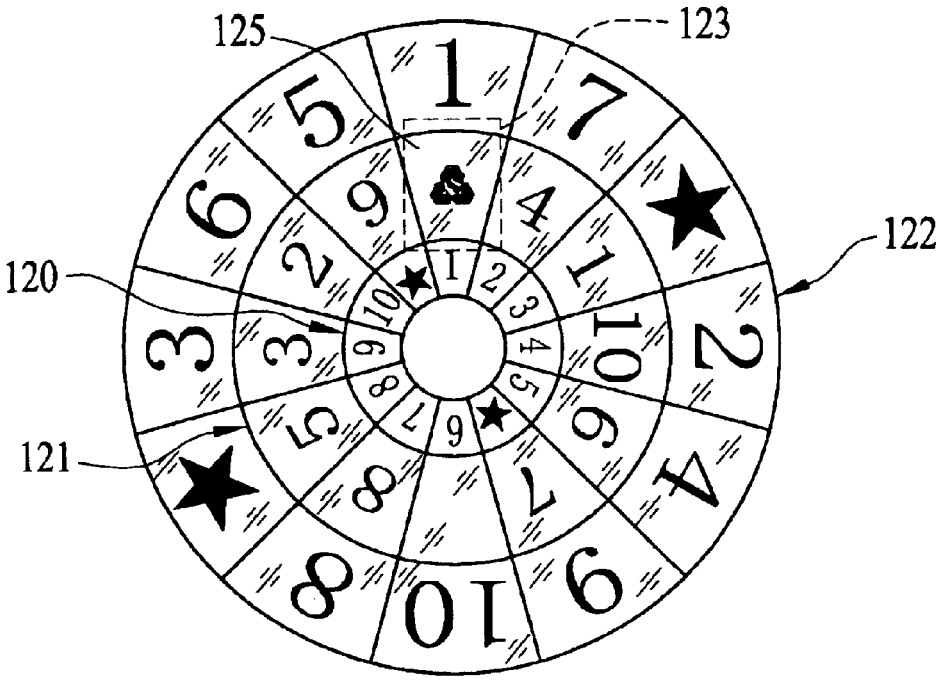
FIG. 20 is a front view illustrating an example of the sub reel behind a second display part.

Although the sub reel is overlapped with the first to third display parts in the above embodiment, the sub reel may be overlapped with only one of the display parts. As shown in FIG. 20, the sub reel 123 is disposed behind the second display part 121. The second display part 121 is composed of the number symbols "1" to "10" and the blank symbols 125. The first and the third display parts 120, 122 are respectively composed of the number symbols and the blank symbols. When the second display part 121 stops with the blank symbol 125 in front of the sub reel 123, the sub reel 123 is exposed through the blank symbol 125 and the transparent parts of the first and third display plates. Then, the sub reel 123 starts rotating to display the symbol in motion, and stops to display the still symbol. The player wins the game if the winning symbol of the sub reel 123 is displayed, and if there is a predetermined winning symbol combination of the sub reel 123 and the first to third display parts 120, 122. This embodiment does not limit the position and the number of the blank symbol and the display plate with the blank symbol. The position of the sub reel can be determined according to the position and the number of the blank symbol.

Though the first to third display plates are composed of three rotary disks having the same diameters in the above embodiment, they may have different diameters. The present invention is not limited to the embodiment in which the first display part is the smallest while the third display part is the largest. For instance, the first display part may be the largest while the third display part may be the smallest. The second display part may be the largest among the three display parts. In addition, the first to third display plates may have other shapes, such as polygon.

Figure 21:
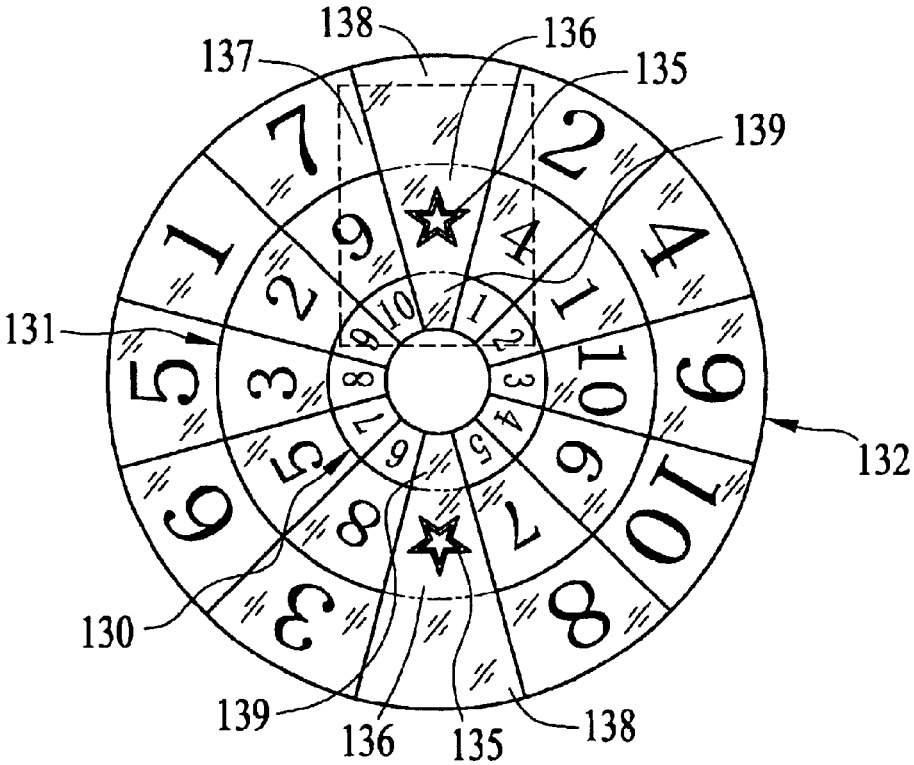
FIG. 21 is a front view illustrating an example wherein the losing symbol is displayed in front of the sub reel when the first to third display plates stop rotating.

It is possible to provide a composite symbol of the symbol of the sub reel and the symbol in front of the sub reel. In FIG. 21, white star symbols 135 and the number symbols "1" to "10" are provided in the second display part 131. The white star symbol 135 to represent the loss is located in a transparent part 136, so that the symbol behind the white star symbol 135 is observable through the transparent part 136. When the white star symbol 135 and the blank symbols 138, 139 of the first and third display parts 130, 132 are arranged on one of the winning lines, the sub reel 137 behind the white star symbol 135 starts rotating.

Figure 22:
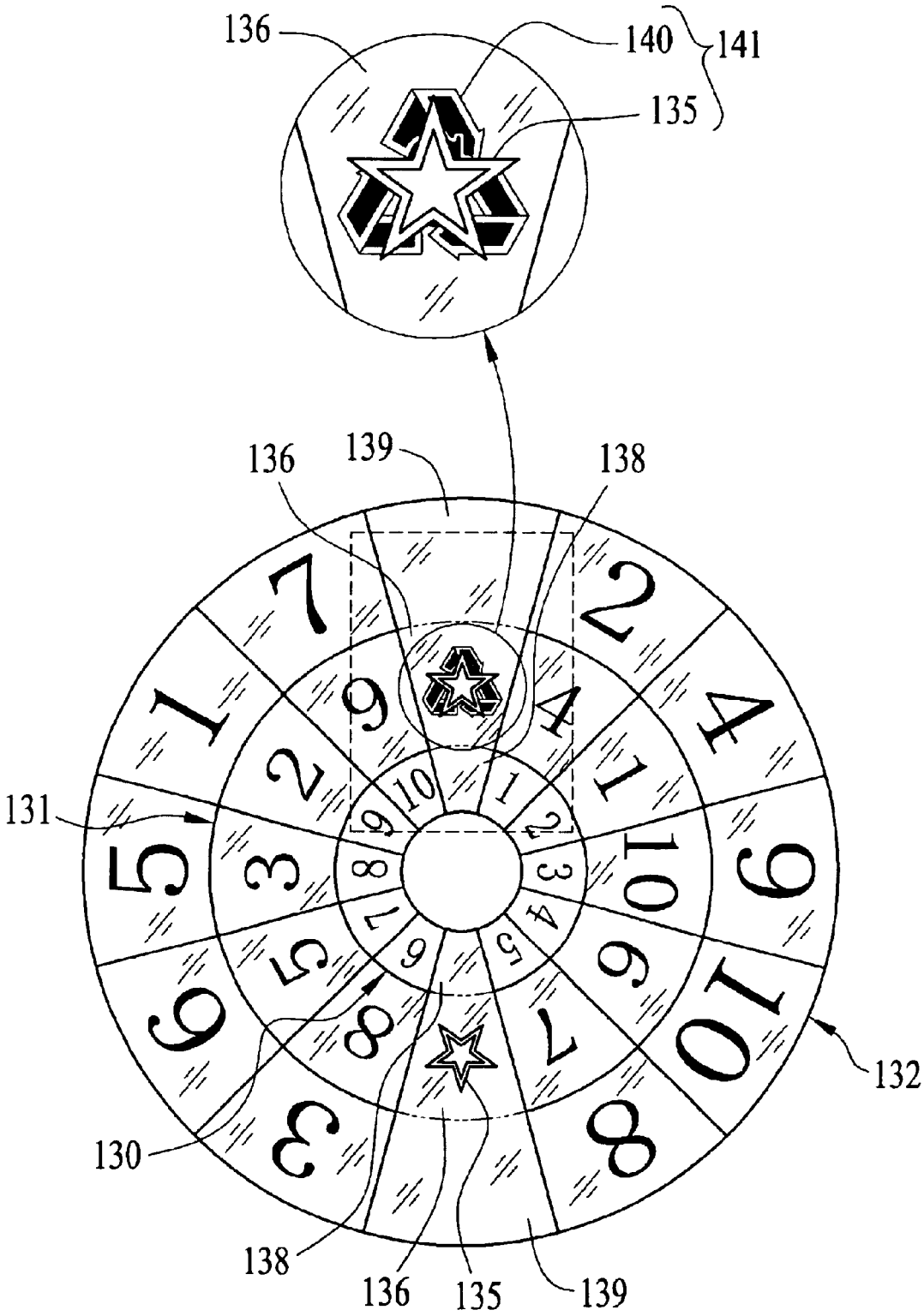
FIG. 22 is a front view illustrating an example wherein the symbols of the sub reel and the second display part compose a composite symbol when the sub reel stops.

For instance, a symbol 140 of the sub reel 137 is displayed behind the star symbol 135, as shown in FIG. 22. In that case, the symbol 140 is overlapped with the star symbol 135 to form a composite symbol 141, so that more dividend coins than that in other wins are dispensed. It is possible to change the number and the kinds of the composite symbols. In addition, though the white star symbols 135 is provided in the transparent part 136, only the part inside the white star symbol 135 may be transparent and the parts outside the white star symbol 135 may be opaque. In that case, the symbol of the sub reel is observable through the transparent part inside the white star symbol 135.

The star symbol 135 is not necessarily stopped on the same line as the blank symbols 138, 139. It is possible to rotate the sub reel when the white star symbol is arranged with other symbols (number symbol, for instance) than the blank symbol. Furthermore, it is also possible to provide three sub reels in line that correspond to the first to third display parts, and to judge the win or loss based on the symbols on three sub reels.

Though the symbol display device is used to execute a sub game after the win in the main game (the slot game) in the above embodiment, the symbol display device of the present invention may be also applicable to a device to determine the amount of dividend coins in the main game or to execute the main game.

Figure 23:
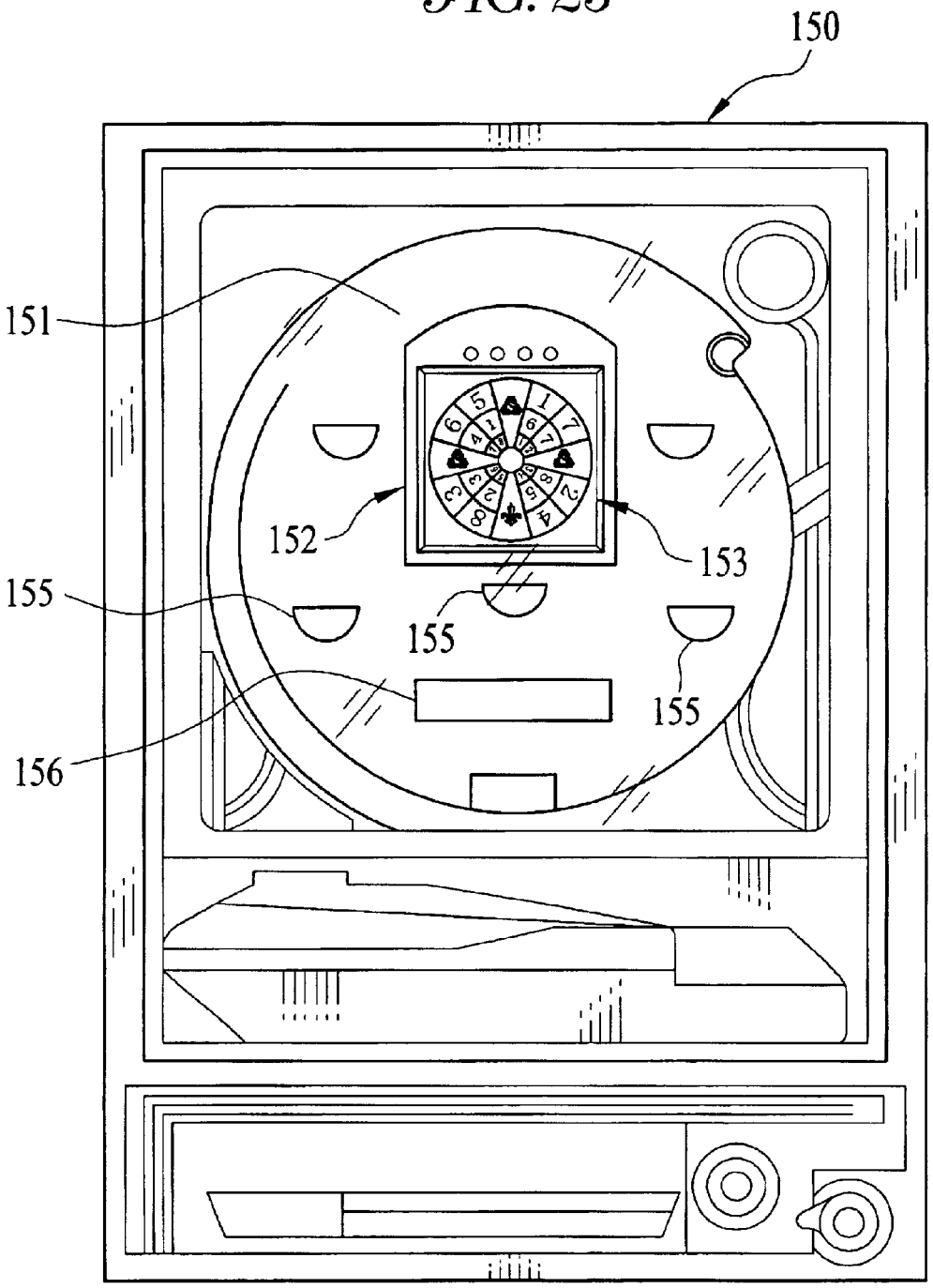
FIG. 23 is a front view illustrating an example of a Pachinko game machine wherein the symbol display device is mounted.

The symbol display device of the present invention may be mounted in the other game machine such as a Pachinko game machine. As shown in FIG. 23, a symbol display device 153 of the present invention is mounted behind a display window 152 formed in the center of a game board 151 in a Pachinko game machine 150. The first to third display plates start rotating under a specific condition such as that, for example, a ball enters a particular hole among winning holes 155 on the game board 151. The player wins a jackpot if the same symbols on the first third display plates are arranged in line. When the blank symbols on the first to third display plates stop in line, the sub reel starts rotating and stops to display the symbol. The player wins a jackpot if the winning symbol of the sub reel is displayed. In the jackpot, an attacker 156 repeats opening and closing a predetermined times, and the player may win a number of premium balls if a ball enters the attacker 156 while it opens. Therefore, the symbol display device of the present invention may give sufficient appeal to the player to win the jackpot, and its various display patterns may enhance the interest of the game.

In the Pachinko game machine, whether the win or the loss is determined by the lottery when a specific condition is completed. In accordance with the result of the lottery, the stop positions for the first to third display plates and the sub reel of the symbol display device are determined. In response to the determination, the symbol display device is operated to rotate the first to third display plates.

In the above embodiments, the symbol display device judges whether the win or the loss in accordance with the combination of the symbols of the first to third display parts and the symbol of the sub reel after the rotation of the first to third display parts and the sub reel. Instead, the symbol display device may determine the win or the loss, and then determine the stop position of the first to third display plates and the sub reel.

Instead of the sub reel, it is possible to use other display device, such as a liquid crystal display device or a display device of dot matrix style or 7 segments style, to display the symbols and the quasi-movement of the symbols.

Various changes and modifications are possible in the present invention and may be understood to be within the present invention.

What is claimed is:

1. A symbol display device for a game machine, comprising:

plural main display units, each of the main display units having a display part with at least one symbol area, in which a symbol is provided, and at least one light-transmissive area in a front side, said main display units being arranged so as to expose the display parts;

a sub display unit, located behind the main display units, so that an axis of rotation of the sub display unit is orthogonal to axes of rotation of said main display units, for displaying symbols in motion and/or a static symbol behind said at least one light-transmissive area; and a winning judging section to judge the win or the loss in accordance with the combination of the displayed symbols of the main display units, the displayed symbol of the sub display unit or the combination of the displayed symbols of the main and sub display units.

2. The symbol display device according to claim 1, wherein the display part is composed of at least one symbol area and at least one transparent non-symbol area;

wherein the light-transmissive area is the non-symbol area, a transparent area inside the symbol, or a transparent area outside the symbol in the symbol area.

3. The symbol display device according to claim 1, wherein the main display unit has at least one transparent part inside or outside of the display part.

4. The symbol display device according to claim 3, wherein the displayed symbol of the sub display unit is validated when the main display units stop and when the light-transmissive area of one of said main display units is overlapped with the transparent parts of other ones of said main display units in front of the sub display unit.

5. The symbol display device according to claim 1, wherein the displayed symbol of the sub display unit is validated when the main display units stop and when the light-transmissive areas of the main display units are arranged in line in front of the sub display unit.

6. The symbol display device according to claim 1, wherein the symbol of the sub display unit is overlapped with the symbol of at least one of the main display units so as to form a single composite symbol.

7. The symbol display device according to claim 1, wherein the sub display unit is a mechanical reel.

8. The symbol display device according to claim 1, wherein the sub display unit is a liquid crystal display device.

9. A symbol display device for a game machine, comprising:

plural display plates arranged concentrically, each of the display plates having a display part with at least one symbol area, in which a symbol is provided, and at least one first transparent area, the display parts being ring-shaped with different diameters;

a sub display unit, located behind the display plates, for displaying symbols in motion and/or a static symbol behind said at least one first transparent area; and a winning judging section to judge the win or the loss in accordance with the combination of the displayed symbols of the display plates, the displayed symbol of the sub display unit or the combination of the displayed symbols of the display plate and the sub display unit, wherein said sub display unit has an axis of rotation perpendicular to an axis of rotation of said plural plates.

10. The symbol display device according to claim 9, wherein each of the display plates has at least one second transparent area inside or outside of the display part.

11. The symbol display device according to claim 10, wherein the displayed symbol of the sub display unit is validated when the display plates stop and when the first transparent area of one display plate is overlapped with the second transparent areas of other display plates in front of the sub display unit.

12. The symbol display device according to claim 9, wherein the displayed symbol of the sub display unit is validated when the display plates stop and when the first transparent areas of the display plates are arranged in line in front of the sub display unit.

13. The symbol display device according to claim 9, wherein the symbol of the sub display unit is overlapped with the symbol of the display plate so as to form a single composite symbol.

14. The symbol display device according to claim 9, wherein each of said at least one first transparent area is radially alignable when the winning judging section judges the win or the loss in accordance with the displayed symbol of the sub display unit.

15. A symbol display device for a game machine, comprising:

plural main display units rotating about a first axis, each of the main display units having a display part with at least one symbol area, in which a symbol is provided, and at least one light-transmissive area in a front side, said main display units being arranged so as to expose the display parts;

a sub display unit, rotating about a second axis different from said first axis and located behind the main display units, for displaying symbols in motion and/or a static symbol behind said at least one light-transmissive area; and a winning judging section to judge the win or the loss in accordance with the displayed symbol of the sub display unit or the combination of the displayed symbols of the main and sub display units.

16. The symbol display device according to claim 15, wherein the display part is composed of at least one symbol area and at least one transparent non-symbol area;

wherein the light-transmissive area is the non-symbol area, a transparent area inside the symbol, or a transparent area outside the symbol in the symbol area.

17. The symbol display device according to claim 15, wherein each of the main display units has at least one transparent part inside or outside of the display part.

18. The symbol display device according to claim 17, wherein the displayed symbol of the sub display unit is validated when the main display units stop and when the light-transmissive area of one main display unit is overlapped with the transparent parts of other main display units in front of the sub display unit.

19. The symbol display device according to claim 15, wherein the displayed symbol of the sub display unit is validated when the main display units stop and when the light-transmissive areas of the main display units are arranged in line in front of the sub display unit.

20. The symbol display device according to claim 15, wherein the symbol of the sub display unit is overlapped with the symbol of the main display unit so as to form a single composite symbol.

21. The symbol display device according to claim 15, wherein the sub display unit is a mechanical reel.

22. The symbol display device according to claim 15, wherein the sub display unit is a liquid crystal display device.

23. The symbol display device according to claim 15, wherein the main display units are plural display plates arranged concentrically, the display parts being ring-shaped with different diameters.

* * * * *